United States Patent [19]

Araki et al.

[11] 4,131,121

[45] Dec. 26, 1978

[54] METHOD AND DEVICE FOR SETTING CURLS IN HAIR

[75] Inventors: Masakatsu Araki; Shuhei Ochi; Toshio Kusunoki; Teizi Ishii; Shinichi Sakata, all of Hikone, Japan

[73] Assignee: Matsushita Electric Works, Ltd., Osaka, Japan

[21] Appl. No.: 667,964

[22] Filed: Mar. 18, 1976

[30] Foreign Application Priority Data

Mar. 26, 1975 [JP] Japan ..... 50-36029

[51] Int. Cl.[2] ..... A45D 7/00

[52] U.S. Cl. ..... 132/7

[58] Field of Search ..... 132/9, 33, 31, 7, 3; 34/97-99, 72, 100, 46; 131/135; 165/3

[56] References Cited

U.S. PATENT DOCUMENTS

| | | | |
|---|---|---|---|
| 1,504,567 | 8/1924 | MacDonald et al. | 132/33 R |
| 1,678,983 | 7/1928 | Hall | 132/33 R |
| 2,156,687 | 5/1939 | Grabner | 132/33 R |
| 2,229,943 | 1/1941 | Touton | 131/140 |
| 2,392,405 | 1/1946 | Phipps | 34/3 |
| 3,004,540 | 10/1961 | Ronzi | 132/9 |
| 3,267,587 | 8/1966 | Niemiec | 34/99 |
| 3,406,743 | 10/1968 | Gomez | 165/12 |
| 3,495,343 | 2/1970 | Duncanson | 34/72 |
| 3,543,412 | 7/1968 | Price | 34/99 |
| 3,724,092 | 4/1973 | McCleerey | 34/99 |
| 3,727,322 | 4/1973 | Walter | 34/97 |

*Primary Examiner*—G. E. McNeill

*Attorney, Agent, or Firm*—Leydig, Voit, Osann, Mayer & Holt

[57] ABSTRACT

A method of setting durable curls in hairs in which a flow of simultaneously warmed and humidified air is applied to rolled hairs. A device for performing the method comprises a base body, a stand erected on the base body preferably in a manner foldable in the base body and a hood of substantially semi-spherical shape for defining an optimum hair setting atmosphere therein and coupled rotatably to upper end of the stay, air warming and humidifying mechanism secured outside the hood adjacent mounting position thereof to the stand for blowing warmed and humidified air inside the hood preferably from ceiling to downward open edge of the hood along inner wall thereof, and means for controlling the mechanism and disposed in the base body for easy access. In an optimum structure of the device, the base body is of a disk shape complementing the circular open end of the hood, so that when the stand is folded and the hood is rotated over the base body the hood will cover the base body compactly for storing.

14 Claims, 31 Drawing Figures

| CURLING TIME (MIN.) | TEMP. & HUMID. RANGE |
|---|---|
| 3 | A |
| 5 | A+B |
| 7 | A+B+C |
| 9 | A+B+C+D |

| CURLING TIME (MIN) | TEMP. & HUMID. RANGE |
|---|---|
| 3 | A |
| 5 | A+B |
| 7 | A+B+C |
| 9 | A+B+C+D |

| CURLING TIME (MIN) | TEMP.&HUMID. RANGE |
|---|---|
| 3 | A |
| 5 | A + B |
| 7 | A + B + C |
| 9 | A + B + C + D |

20
13
17
12
24
27. 28
22
11

METHOD AND DEVICE FOR SETTING CURLS IN HAIR

This invention relates to methods and devices for curling and setting hairs.

Conventionally, hair curling and setting are to be achieved by keeping a user's head with the hair wound on curlers in a hair setting hood having an inner atmosphere of such a high temperature as about 60° to 70° C. and such a low humidity as about 10%, for a period of about 10 minutes. In FIG. 1, there is shown an exemplary one of conventional hair setting devices, wherein an electric motor 1 rotates a fan 2 to blow air heated by a heater 3 inside a hood 4. Time variations in water content of the hair to be curled with this device are diagrammatically shown in FIG. 2, in which curve section A represents a dehydrating state and curve section B represents a hydrating or water absorbing state. In the drawing, the time is taken on the abscissa in the unit of minutes and the water content in the hair is taken on the ordinate in the unit of percentage. $T_1$ represents the time for which hair rolled on curlers are dried within the hood of setting device, that is, the time for which a dry-type hair dryer is used, whereas $T_2$ represents the time in which the hair is left outside the hood naturally with the curlers removed. The room condition is at a temperature of 20° C. and relative humidity of 60%. As evident from the diagram, while the head is kept within the hood for 10 minutes, the water content in the hair will be reduced from 12% in the initial period to 9.5%. Then, after the head is removed out of the hood, the dehydrated hair will absorb the atmospheric moisture and return to be of the water content of 12% in the initial period tending to have the water content balanced with the atmospheric humidity. When the hair absorbs the moisture, in this case, the water content in the hair will be unbalanced and will act to release the internal stress so that the curls of hair will be likely to stretch so as to reduce the durability of the curls. Observing the curled hair in comparison with a curling effect standard which shall be detailed later with reference to FIG. 9, it is seen that the hair in the state of about 7th stage curling effect of the standard just after the head is taken out of the hood with the curlers removed will be already in 2nd stage of the standard or less than that after one hour. It is said also that, when hair is dried excessively, it will be likely damaged because a substance C-heratin which fills the clearances between fibrils forming each hair is so soft that, when the hair is excessively dried, it will be difficult to return it to the original state, that is, it will be difficult for it to again absorb water, analogously to dried grass. Thus, in the state shown in FIG. 2, the hair is dehydrated so much that split ends will be likely to be produced.

In FIG. 3 there is shown a so-called salon type wet dryer, which has been described, for example, in Japanese Utility Model Publication No. 12842/1972. In the drawing, 1 is a motor, 2 is a fan, 3 is a heater and 5 is a steam generator. The usage of this dryer is that steam generated in the steam generator 5 is delivered into the hood 4 so that the hair absorbs water first, following which the steam is cut off and hot air is blown into the hood to dry and curl the hair wetted in the preceeding step. It is an object to thereby protect hair from drying excessively. However, in this method since the absorption of water and dehydration of hair are separated into two steps, a long time must be spent under the hood.

FIG. 4 shows diagrammatically variations in the water content in hair where the salon type wet dryer of FIG. 3 is used. The room condition is the same as in the case of FIG. 2, whereas $T_1'$ is the time for humidifying hair with steam and $T_2'$ is the time for drying hair with the dryer. When hair is humidified with steam for 10 minutes and is dried with the dryer by changing over a switch of the device when the water content in the hair rises to about 13.7% from the initial 12% state, the hair will be dehydrated in such state as shown by the curve B' in FIG. 4.

In the characteristics of FIG. 4, when the drying time after hair is humidified becomes $T_o$, the water content in the hair will substantially balance with the atmospheric humidity. If the head is taken out of the hood and the curlers are removed at this time, durable curls will be obtained. However, the value of this drying time $T_o$ is so unstable depending on such various factors as the amount or length of the hair of the individual, manner of winding the hair on the curlers and the like that it is really difficult to set a proper drying time on the device. Even if the hair drying time $T_o$ of any person is set, such trouble as the shortage or excess of drying will be inevitable. When hair is excessively dried as of the dry type dryer in FIG. 1, the curls will be low in durability. In case the drying is short, the problem is that the hair will be so soft that the initial curling effect will soon be lost.

In this salon type wet dryer, of FIG. 3, further, in case each section 7 of the hair is wound on a curler 6 as shown in FIG. 5 and uniformly humidified with steam to the extent of reaching the interior part 7B of the hair section and then dried with hot air, the drying of exterior part 7A of the hair section will progress but the hair at the exterior part 7A will be likely to be damaged by excess drying by the time that the interior hair has sufficiently dried. Due to the two separate humidifying and drying steps, further, there is the problem that it takes time to finish the curling, it is difficult to adjust the curled state to be optimum, and the switching of the device between its moves is troublesome.

The present invention has been suggested to remove the foregoing problem of the prior art and, according to the present invention, the problems have largely been solved by keeping the water content balanced with the atmospheric humidity while simultaneously applying heat and moisture to hairs within a hood without dehydrating the.

A primary object of the present invention is, therefore, to provide a hair curling method which can provide durable curls within a short time and a device for performing such method.

Another object of the present invention is to provide a hair curling method and device which can apply curls to hair without damaging it.

A further object of the present invention is to provide a hair curling method and device which can perform low temperature hair setting within a time as short as possible.

Other objects and advantages of the present invention shall be made clear as the following description advances in detail a preferred embodiment of the invention as illustrated in accompanying drawings, in which.

It is generally considered that, in order to quickly curl hair, the hair heating temperature should be elevated while, in order to increase the durability of the curls, the hair should be kept in a state of water content balanced with the atmospheric humidity without dehydration within the hair setting atmosphere of the hood. When an atmosphere satisfying both of these conditions is applied, hair will be quickly and durably curled.

Figure 1:
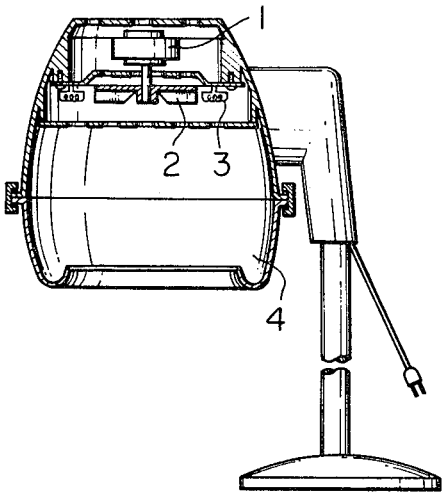
Fig. 1 (PRIOR ART)
FIG. 1 is an elevation of a conventional hair setting device with a dryer hood vertically sectioned.
Figure 2:
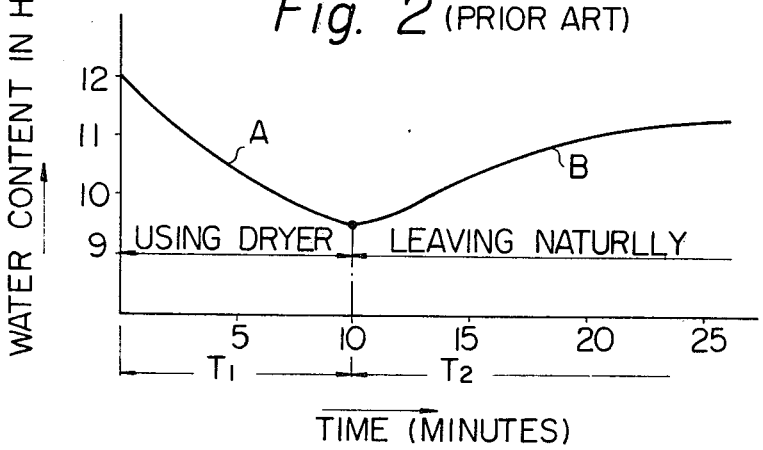
Fig. 2 (PRIOR ART)
FIG. 2 is a diagram showing time variations in water content of hair to be curled with the device of FIG. 1.
Figure 3:
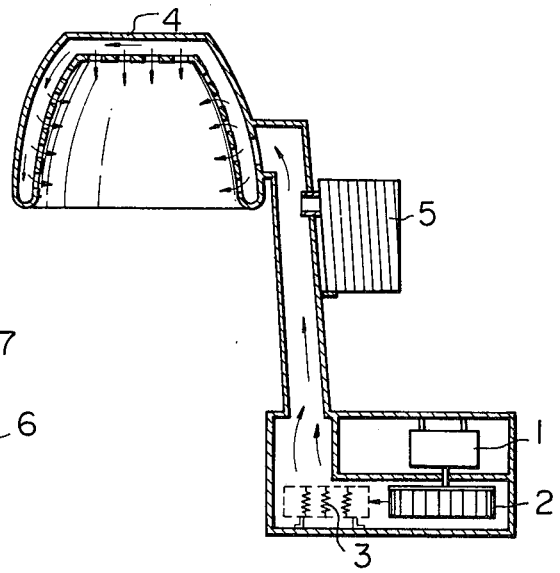
Fig. 3 (PRIOR ART)
FIG. 3 is a vertically sectioned view of another conventional hair setting device with a wet type dryer hood.
Figure 5:
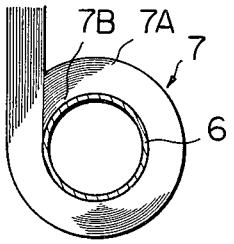
FIG. 5 is a schematic explanatory view of a hair section being curled with the device of FIG. 3.
Figure 4:
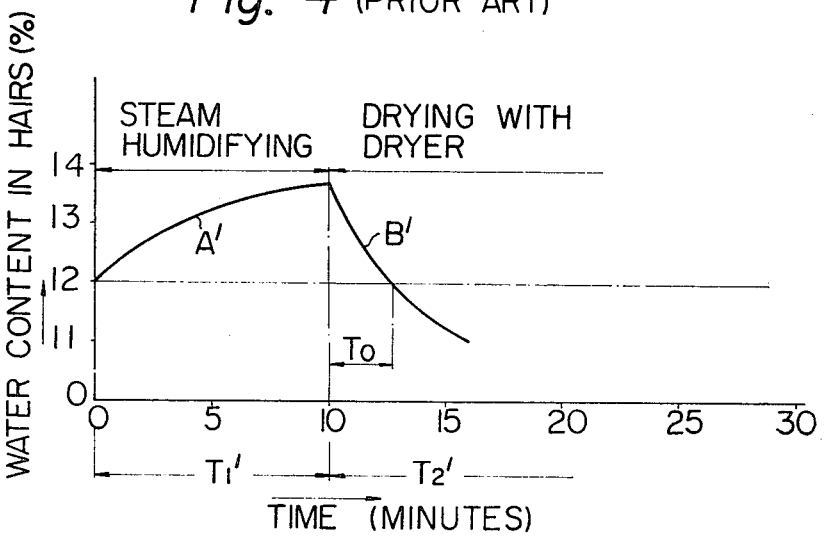
Fig. 4 (PRIOR ART)
FIG. 4 is a diagram showing time variations in water content of hairs to be curled with the device of FIG. 3.
Figure 6:
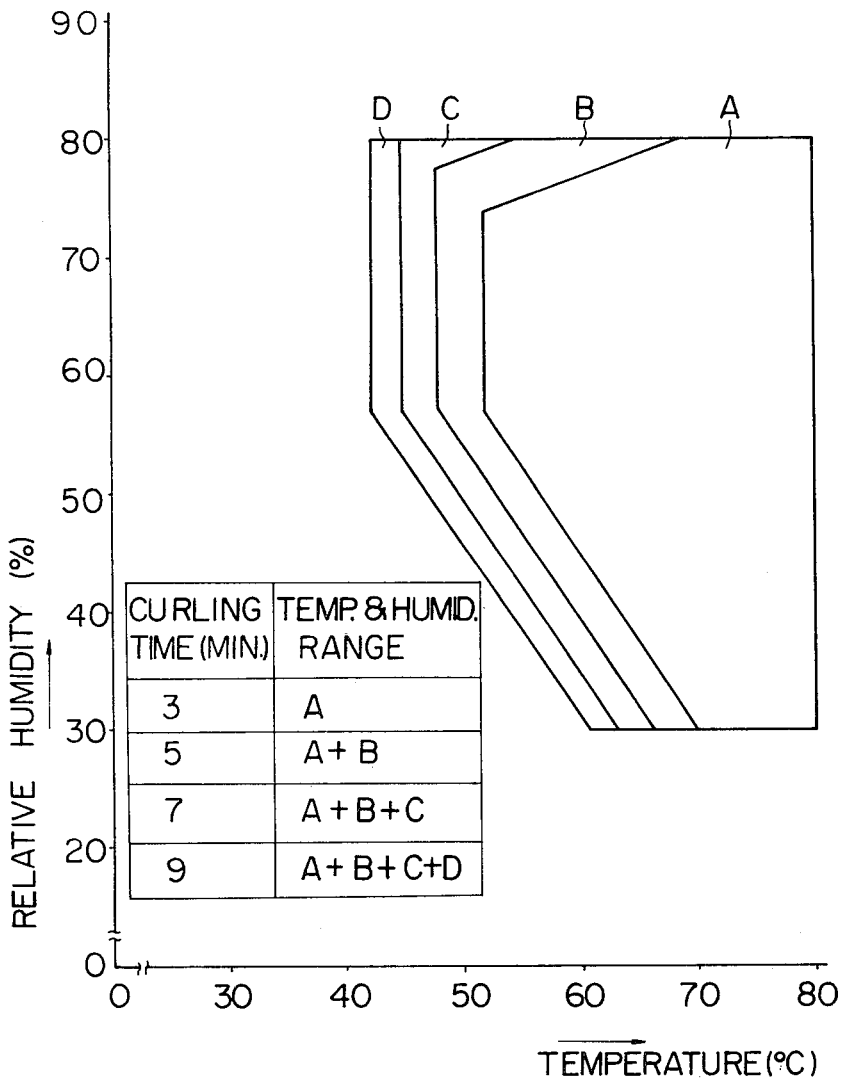
FIGS. 6 to 8 are diagrams showing optimum temperature and humidity conditions in the hood of device under different atmospheric conditions for obtaining satisfactory curls.
Figure 7:
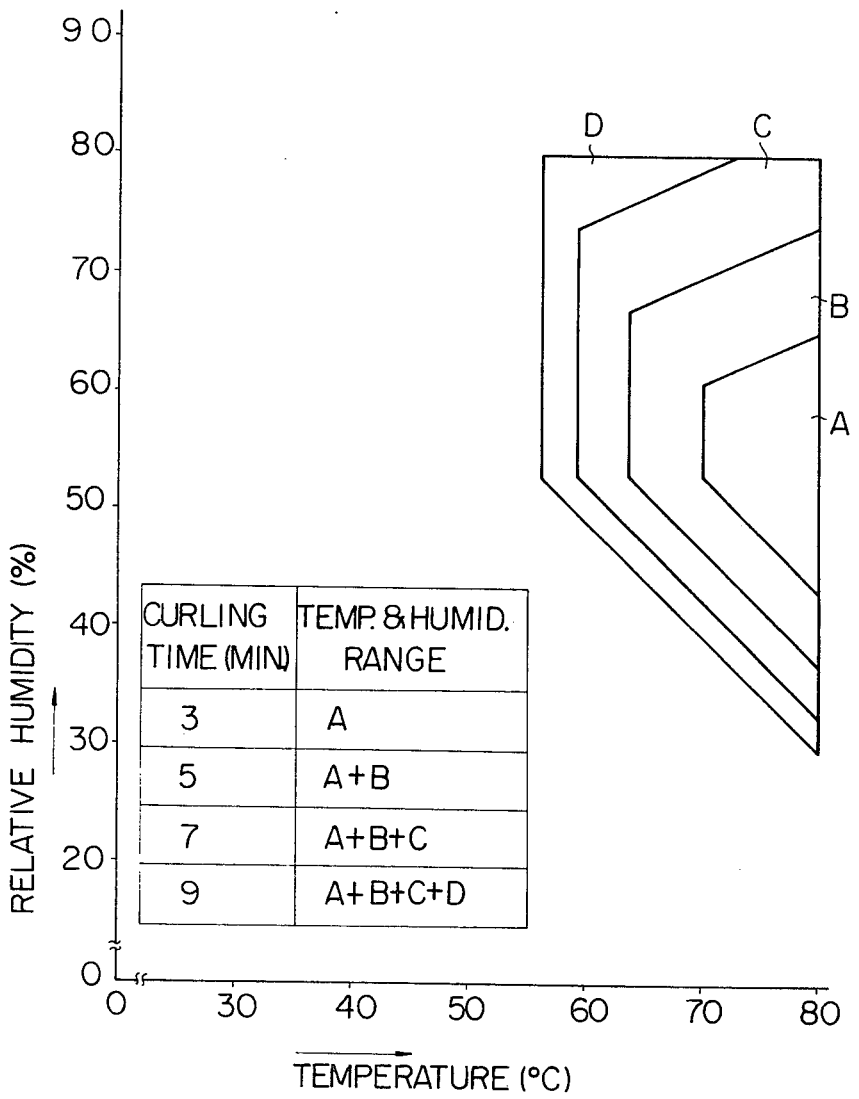
Figure 8:
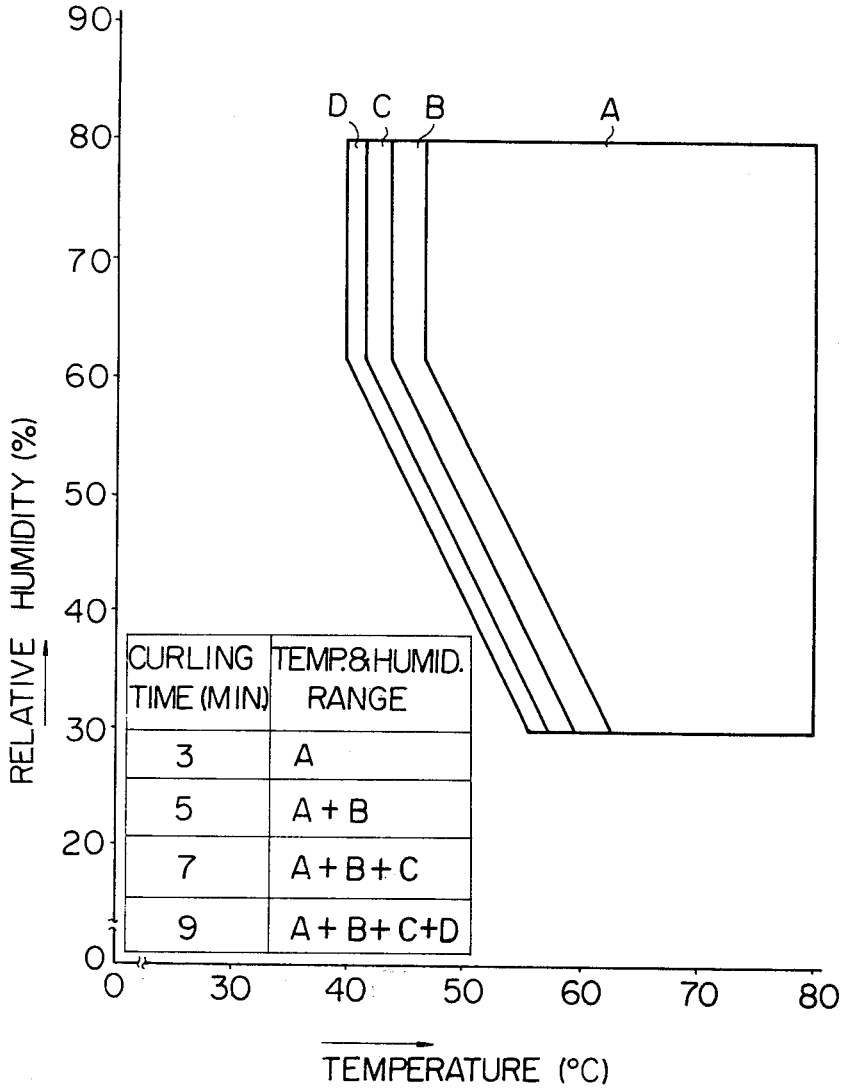

In developing the present invention, considering the atmosphere inside the hair setting hood to be important for satisfying both of the above conditions, the optimum relation between the curling effects in the initial period and after 6 hours of the hair setting and the temperature and humidity within the hood were actually determined experimentally. The range of curling effect with which women in general could be satisfied was selected on the basis of results obtained after investigating women's consciousness of hair setting, according to our investigation it has been found that, when the curling effect was more than 4th stage in the later defined curling effect standard, the hair style seemed properly set and, therefore, in selecting the relations between curling effect and atmospheric conditions, the curling effect in the initial period of more than 5th stage and the curling effect after 6 hours of more than 4th stage were considered to be satisfactory. Diagrams of FIGS. 6 to 8 show the thus selected relations for hair setting under different room conditions. In this case, a curler having a diameter of 24 mm. was used and the curling effect was determined to be more than the 5th stage in the initial period and more than the 4th stage after 6 hours. In FIGS. 6 to 8, the hair curling temperature is taken on the abscissa, the relative humidity is taken on the ordinate and the range A shows the case where the curling time in the hood is 3 minutes. The range of the temperature and humidity will expand in such manner that, when the curling time is 5 minutes, the range will be A + B, when the curling time is 7 minutes, the range will be A + B + C and, when the curling time is 9 minutes, the range will be A + B + C + D. FIG. 6 represents the case where the atmospheric conditions are a temperature of about 20° C. and humidity of about 60%, FIG. 7 is of respectively about 20° C. and 80% and FIG. 8 is of respectively about 20° C. and 40%. These diagrams teach that, if the temperature and humidity within the hood are limited to be within such ranges as above, durable curls will be able to be set, and further that the temperature and humidity range satisfying the curling effect varies with the temperature and humidity of the room atmosphere in which the hair setting is performed and also depending on the curling time of wearing the hood. For example, in the case of 20° C. and 60% as a typical room temperature and humidity condition of FIG. 6, it will be understood that, the longer the curling time, the wider the optimum temperature and humidity range. Now, in case the hood's atmosphere is set at 60° C. and 60%, it is seen that satisfactory curls will be made in 3 minutes but, when they are reduced to 50° C. and 60%, it will take 5 minutes and, when they are further reduced to 45° C. and 60%, it will take 7 to 9 minutes.

In the present invention, in order to provide an optimum temperature and humidity range that achieves the satisfiable curling effect within the hood, desired temperature and humidity conditions are to be established by simultaneously supplying hot air and steam into the hood and varying their absolute amounts. Now, for example, in order to establish the inside hood atmosphere of 60° C. temperature and 60% humidity under the room atmosphere of 20° C. temperature and 60% humidity, it is necessary to supply moisture simultaneously with the hot air, because, if the air temperature of 20° C. with 60% humidity is elevated to 60° C. without supplying any moisture, the humidity will be reduced to be about 6 to 10%.

According to the present invention in which hair is curled within such temperature and humidity range, durable curls are obtained and this is thought to be because the water distribution within the hair is kept constant so that the internal stress in the hair will be less released, whereas in the hair curled with a conventional dry type dryer the drying of the outer surface of each hair will progress and internal water will move to cause the water distribution to be unbalanced and thereby the internal stress will be released and the curled hair hair will be likely to stretch. Further, in the present invention, curls can be made within a short time. This is thought to be because the two curling factors that (1) the distance between molecules will be enlarged by moistened swelling of the hairs with water and (2) a motion of polypeptide molecules in the hair will be made active by heat and carried out simultaneously.

Figure 9:
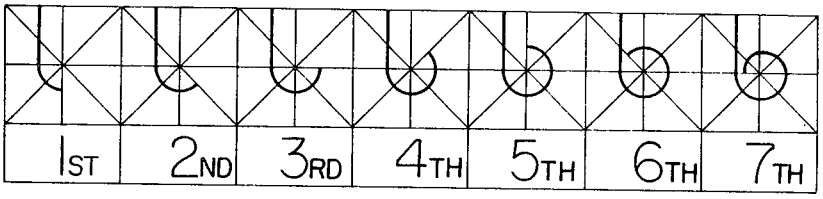
FIG. 9 is a diagram for explaining a standard for defining respective stages of hair curling effect.
Figure 10:
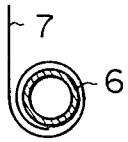
FIG. 10 is a schematic view showing the winding of hair on a curler in which the curling effect standard of FIG. 9 is determined.

The definition of the curling effect standard employed in the present invention shall be explained now with reference to FIG. 9, wherein the diagram defines illustratively the curling effect in seven sequential stages. That is, the curl of a hair as seen from an axial side of the curl is divided into 8 equal divisions, a numerical value is given to each stage sequentially in response to the position of the hair tip and the respective stages of the curling effect is represented by numerals 1st to 7th. In order to measure the curling effect under the same condition, a common curling manner as shown in FIG. 10 has been employed, wherein a hair 7 is wound on a net curler 6 of a diameter of 24 mm. so that the hair tip will be just vertically below the curler. What are most important for the hair setting are the initial curling effect and how long the initial effect will be retained, or how much the initially curled hairs will stretch after a certaine time period.

Figure 11:
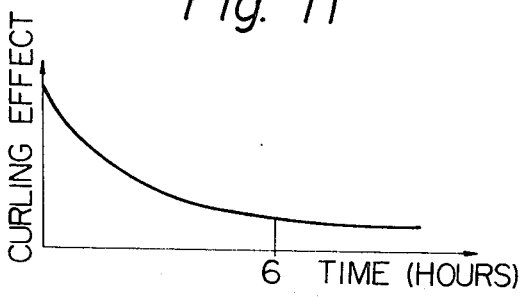
FIG. 11 shows diagrammatically a relation of the curling effect to the time.

The relation between the curling effect and time is diagrammatically shown in a curve of FIG. 11. The drop of the curling effect is fast in the range of initial 6 hours but is slow thereafter. Therefore, in the present invention, the durability of the curls has been determined by observing to which younger stage of the curling effect standard the initial effect of an elder stage has shifted after six hours.

Now, the structure of the most preferable hair setting device according to the present invention shall be explained.

Figure 12A:
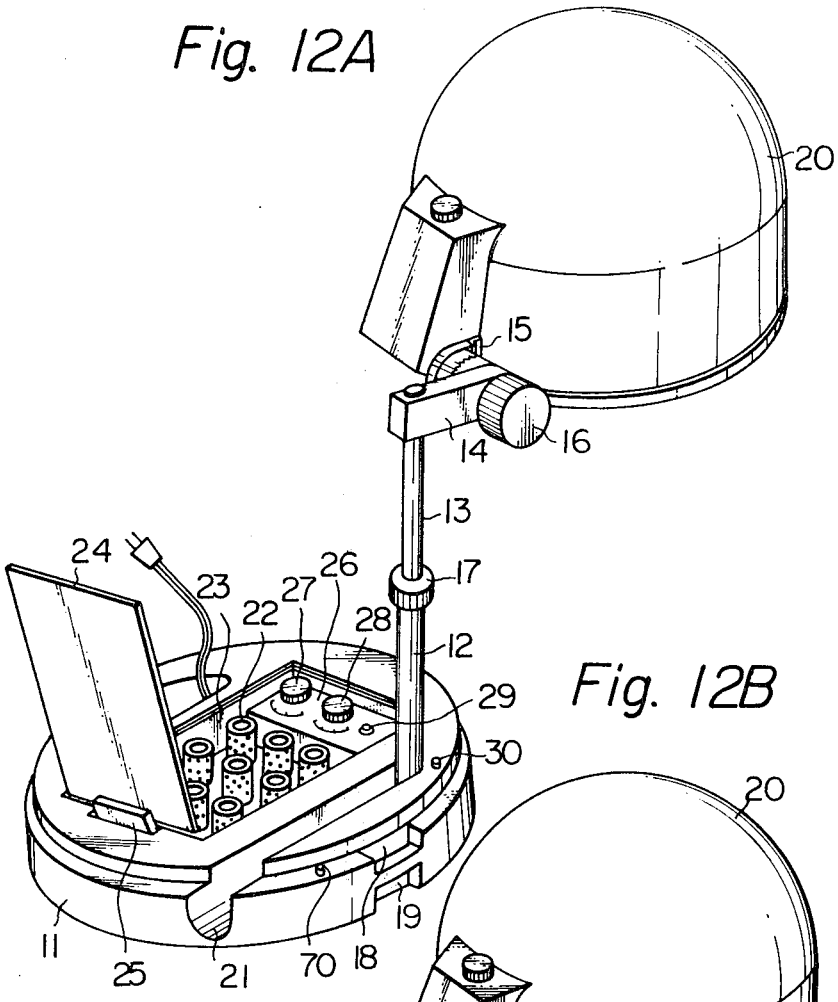
FIGS. 12A and 12B are perspective views showing a preferred embodiment of hair setting device according to the present invention in its ready state for use and folded state for storing, respectively.
Figure 12B:
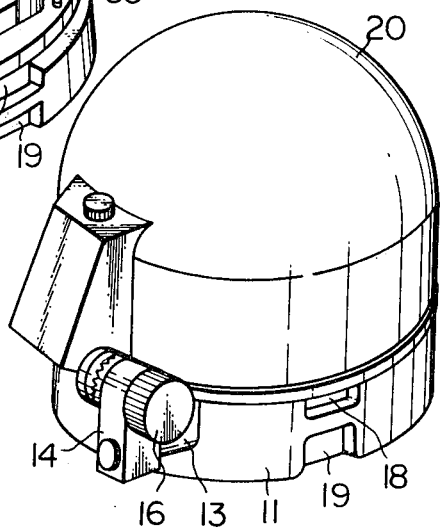

In FIGS. 12A and 12B, there is shown the device in perspective views respectively in a stage where the device is set ready for use and in a stage where the same is compactly folded for storage. In the drawings, a base body 11 of substantially a hollow disk shape has a stand made up of a tubular element 12 pivoted at the lower end thereof to an offset position of the body 11 so as to be manually erectable. An extension tubular element 13 is coupled to the element 12 for telescopic movement between an extended position and an retracted position, and a bracket bar 14 is fixed to exterior end of the extension stay 13 while a plate member 15 to which a later detailed hair-set functioning mechanism is to be fixed is rotatably fitted through an also later described clutch means.

A Substantially semi-spherical hood 20 for defining hair setting atmosphere is fixed to the plate 15. The telescopic movement of the tubular element 13 is adjustably locked by means of a threaded cap 17 on an end of the element 12.

In the peripheral wall of the device body 11, there are provided a pair of recesses 18 at diametrally opposing positions for allowing easy access to the open end edge of the hood 20 when a user intends to set up the hood from the folded storage position of FIG. 12B into a position of FIG. 12A for use, and a further pair of recesses 19 defining hand receiving spaces for carrying the entire device are provided at positions advantageously below the respective recesses 18. In the upper surface of the body 11, there is provided a groove 21 opened at the peripheral wall of the body 11 and capable of housing the tubular elements 12, 13 telescoped together. Also provided is a recess 23 for containing such accessories as net curlers 22 and the like, and a lid 24 coupled by a hinge 25 to the body 11 at an end edge so as to be rotatable between a position closing the recess 23 and an open position where the lid 24 functions as a mirror. Also disposed in the recess 23 is an operating panel 26, which is furnished with a timer knob 27, temperature control switch knob 28 and a pilot lamp 29. Adjacent the peripheral edge of the upper surface of the body 11, is a push button 30 coupled to a lock mechanism for erected stand 12, 13, depression of which unlocks the mechanism for allowing the stand 12, 13 to be folded in the groove 21.

Figure 13A:
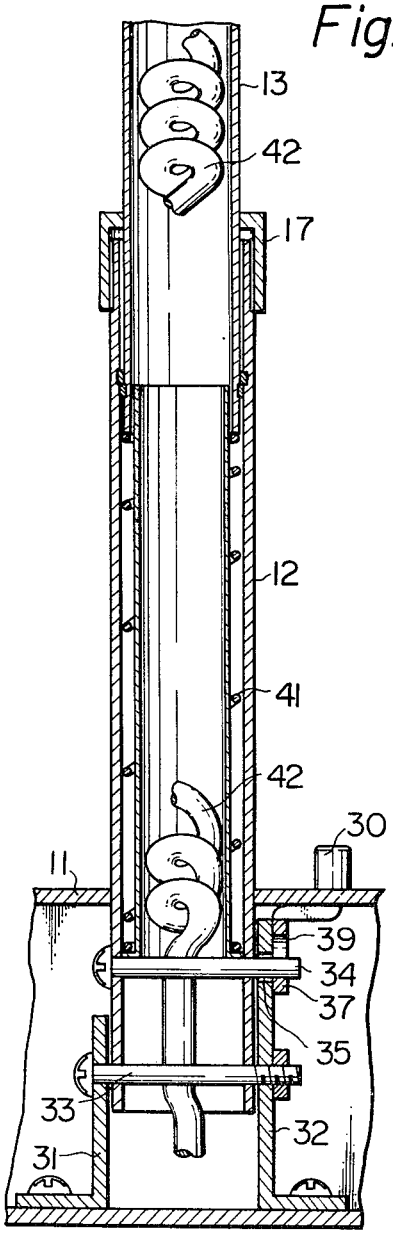
FIGS. 13 to 15 are fragmentary views of respective parts in the device of FIG. 12 as magnified and partly sectioned for explaining the structure of the device.
Figure 13B:
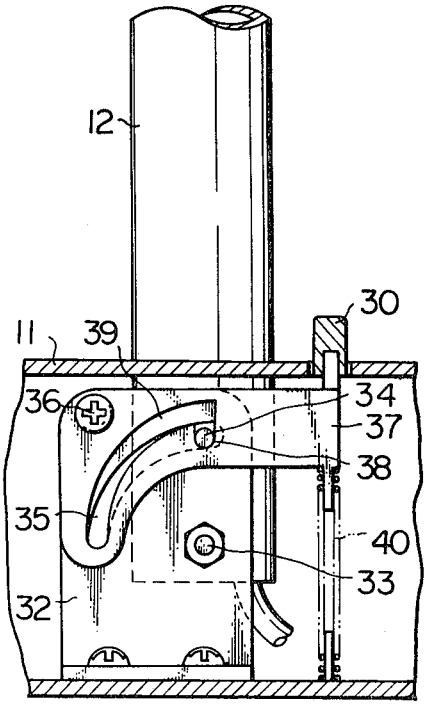

Referring next to FIGS. 13A and 13B of fragmentary magnified views of a rotary hinge and lock mechanism for the stand 12, 13, a pair of parallel metal plates 31 and 32 respectively L-shaped in section are fixed to the bottom plate of the body 11, the stand 12, 13 is pivoted adjacent an end thereof between the plates 31 and 32 by means of a screw pin 33 and another pin 34 is fixed to the stand at a position spaced from the pin 33 parallel to the axial direction of the stand. In one of the plates 31 and 32, specifically the plate 32 which is extending slightly higher than the other, an arcuate slot 35 is made, in which an end of the pin 34, extending out of the plate 32, rests and slides along the same when the, 13 12 is rotated about the pivot pin 33. With a screw 36 fixed to an upper end corder of the plate 32, a movable plate member 37 is pivoted at an end corner to the plate 32. The member 37 has a short vertical slot 38 for locking the extended end of the pin 34 against its sliding movement along the slot 35 and an arcuate slot 39 coinciding with the slot 35 and communicated with the vertical slot 38 at the upper part of the latter. At a free end away from the pivoted end of the plate member 37, there is provided an extension connected to the push button 30, and a compression spring 40 biases the free end of the plate member 37 upward so that the push buttom 30 will be normally in its exposed position. That is, in the state of the device where the, 13 12 is vertically erected as shown in FIGS. 13A and 13B, the movable plate member 37 biased into its upper position urges the extended end of the pin 34 into the locked position inside the vertical slot 38 so as not to slide along the arcuate slot 35 of the plate 31 and thereby the, 13 12 is held in its erected position. When the push botton 30 is depressed against the biasing force of the spring 40, on the other hand, the movable plate member 37 is rotated and the respective arcuate slots 35 and 39 are brought into matching alignment with each other so that, if the, 13 12 is rotated manually to fold it into the groove 21, the pin 34, displaced out of the vertical slot 38, will slide along the thus aligned slots 35 and 39 to allow the stand to be rotated.

Inside the tubular, 13 12, a compression spring 41 is inserted to normally bias the extension element 13 upward so as to counter-balance the weight of the hood 20 and its attachments. A cable 42 of electrically conductive wires also passes through the stand.

Figure 14:
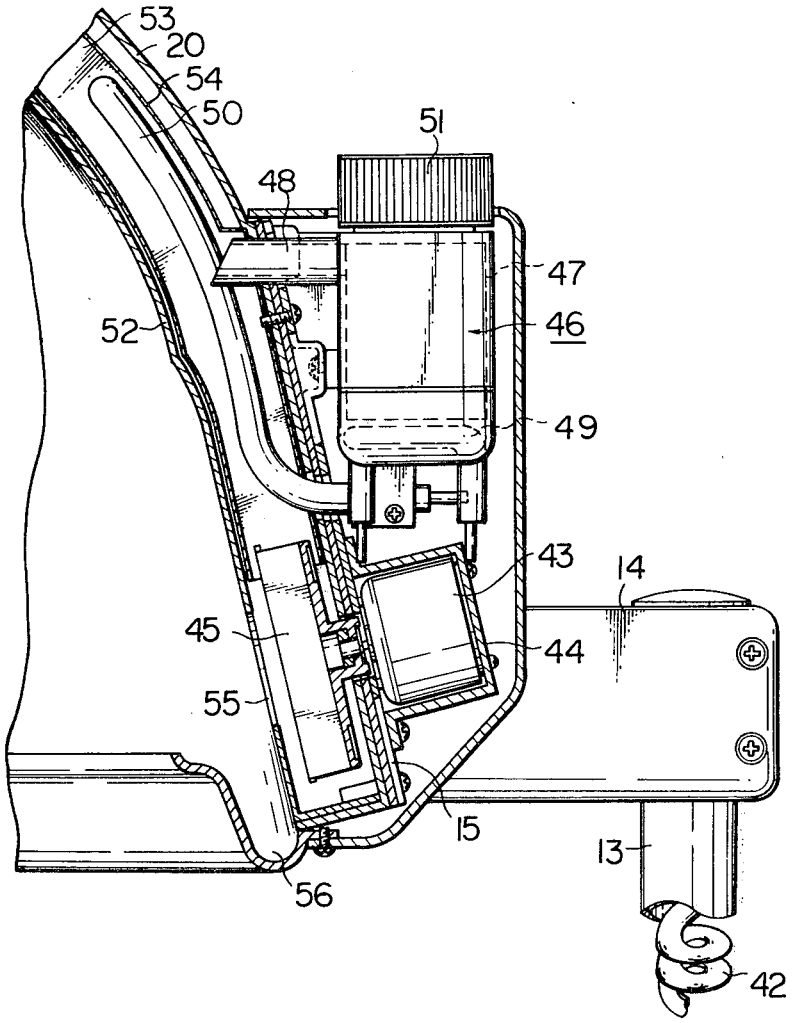
Figure 17A:
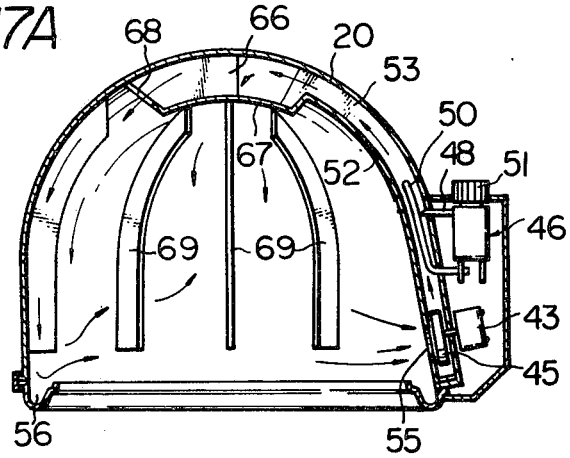
FIGS. 17A to 17C are schematic vertical section, bottom plan view and fragmentary elevation at the air suction port of the hood of the device shown in FIG. 12, respectively.

Details of the hair set functioning mechanism fitted to the hood 20 are shown in FIG. 14, wherein the semi-spherical hood 20 is provided with an air duct 53 extending vertically along inner peripheral wall of the hood and is mounted to the plate member 15 fixed to the bracket bar 14 which is secured to the tubular element 13. An electric motor 43 is mounted to the other side of the plate 15 as held by a casing 44 so as to position a drive end of rotary shaft of the motor inside the duct 53 of the hood 20, and a fan 45 is mounted to the rotary shaft end so as to be rotatable within the duct 53. A steam generator 46 comprises a boiler 47 secured to the plate 15, a nozzle 48 communicative with upper part of the boiler 47 and opened inside the duct 53 of the hood 20, a heater 49 positioned below the boiler 47 and a cap 51 closing water feeding port of the boiler 47. A further heater 50 extends in the duct 53 for heating air blown through the duct 53 by the fan 45. A shielding plate 54 is fitted to inside wall of the duct 53 so as to insulate it from the heat of exhausted steam from the nozzle 48 or of the heater 50. Inner wall 52 of the duct 53 has an air suction port 55 opposed to the fan 45 so that, as the fan 45 is rotated, the air inside the hood 20 will be sucked through the port 55 into the duct 53. As shown in FIGS. 14 and 17A, the hood 20 is further provided with an upwardly and inwardly directed circumferential lip defining a groove 56 U-shaped in section and extending along lower circular edge of the hood for collecting any condensation on the inner wall of the hood.

Figure 15A:
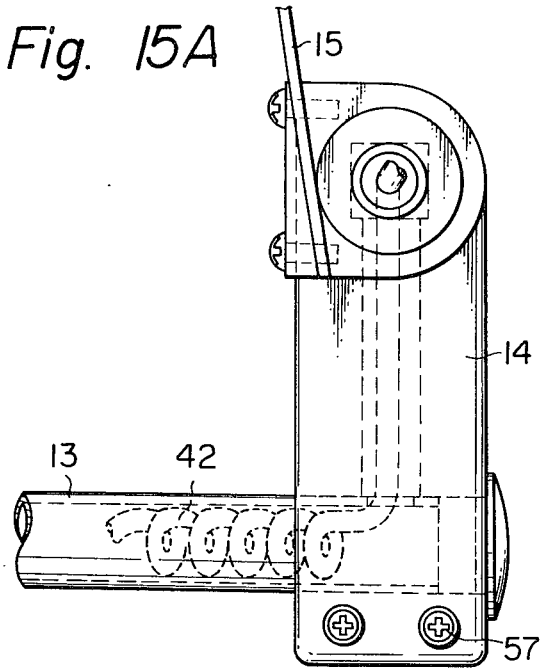
Figure 15B:
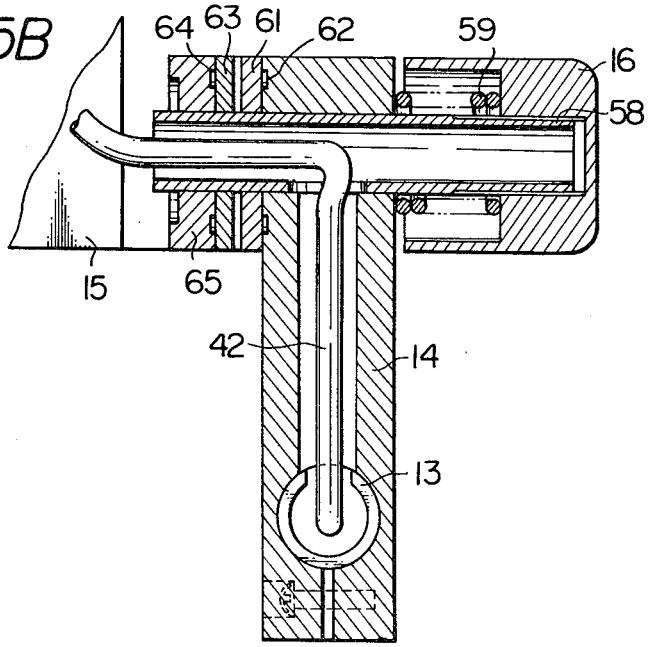

In FIGS. 15A and 15B, there is shown the clutch means for rotatably holding the hood 20 to the extension stay 13. The bracket 14 is secured to the element 13 by means of screws 57. A supporting tubular bar 58 is slidably received by the bracket 14 in crosswise relation thereto. A rotation adjusting knob 16 which bears against a coil spring 59 is screwed to one end of the bar 58 whereas a disk 61 having clutch teeth on one side and anti-rotation projections 62 on the other side is mounted to the other end of the bar 58 on the opposite side of the bracket from the knob 16. A second disk 63 having clutch teeth on one side and anti-rotation projections 64 is also mounted on the bar 58 and fixed thereto so its clutch teeth are in mesh with those of the disk 61. A fixture member 65 to which the plate member 15 of the hood 20 is fixed is mounted to extended end of the bar 58 from the disk 63 to engage with the projections 64 thereof and locked against escapement from the bar 58. Thus, rotation of the knob 16 in a direction to compress the spring 59 will pull the bar 58 so as to tighten the engagement of the clutch teeth of the respective disks 61 and 63 thereby to tightly hold the hood 20 to the stand 12, 13 while rotation of the knob 16 in the other direction will loosen the engagement of the clutch teeth so as to allow the hood to be rotated with respect to the stand.

Figure 16A:
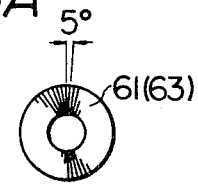
FIGS. 16A and 16B are plan views of clutch members used in the device of FIG. 12.
Figure 16B:
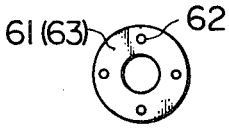

In FIGS. 16A and 16B, the respective sides of the disk 61 or 63 are shown in plan views.

Figure 17B:
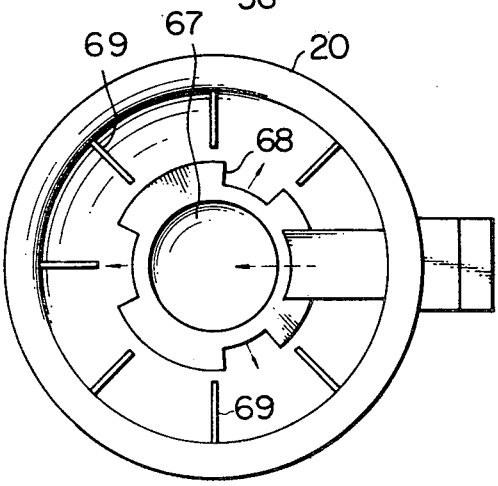
Figure 17C:
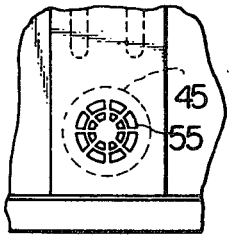
Figure 24:
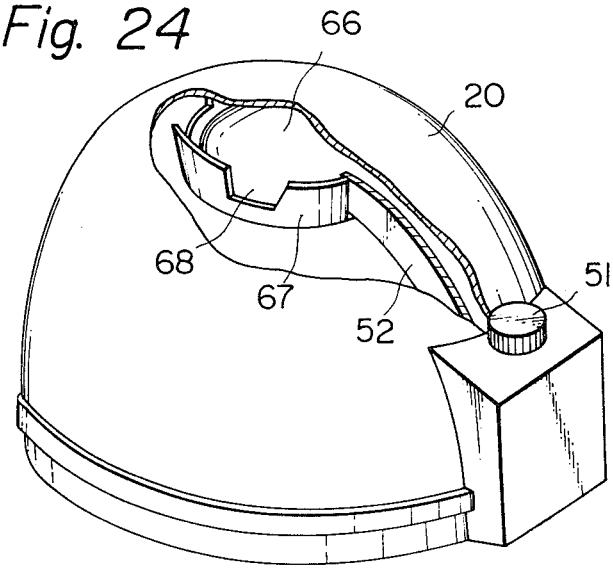
FIG. 24 is a perspective view of the hood of the device shown in FIG. 12.

FIGS. 17A to 17C as well as FIG. 24 show the structure of the hood 20 in detail, in which it will be seen that an air-stream rectifying chamber 66 communicating with the duct 53 is formed at the central top portion of the inner wall of the hood 20. The chamber 66 is defined by a substantially bowl-shaped plate 67 having a plurality of air passing ports 68 for scattering the air stream in radial directions. A plurality of vertical ribs 69 are provided on the inner wall of the hood 20 regularly spaced from one another to guide the scattered air in downward direction to the open end of the hood. Thus mixture of hot air and steam flows, as the fan 45 is rotated, in the direction indicated by arrows through the duct 53 and is blown into the hood through the ports 68 after being rectified in the chamber 66. The gaseous mixture blown downward along the inner wall of the hood, guided by the ribs 69 and reaching the U-shaped groove 56, is thereby turned to be sucked by the fan 45 through the port 55 into the duct 53, where the air is supplied with the heat and steam so as to be recirculated into the hood 20.

Figure 18:
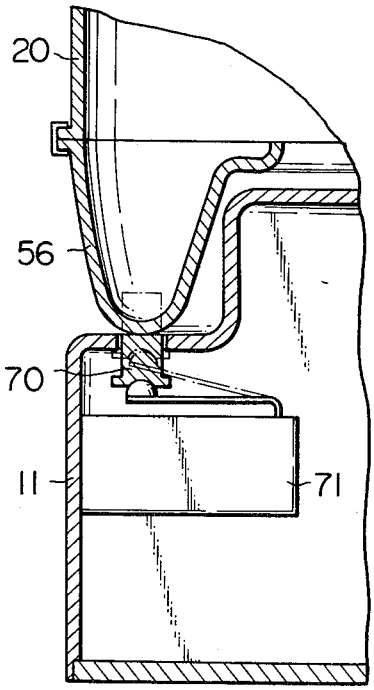
FIG. 18 is a fragmentary sectioned view showing a microswitch operation in the device of FIG. 12.

FIG. 18 shows a limit switch 71 provided in the device body 11 for connecting and disconnecting electric source power to a later described electric circuit of the device. In the illustrated state, the hood 20 folded onto the device body 11 depresses a push botton 70 of the switch 71 with the lower end edge of U-shaped groove 56 so that the switch 71 will be turned OFF. When the hood 20 is pulled up for setting up the device for use, the button 70 resiliently returns to the extended position to turn the switch 71 ON.

Figure 19:
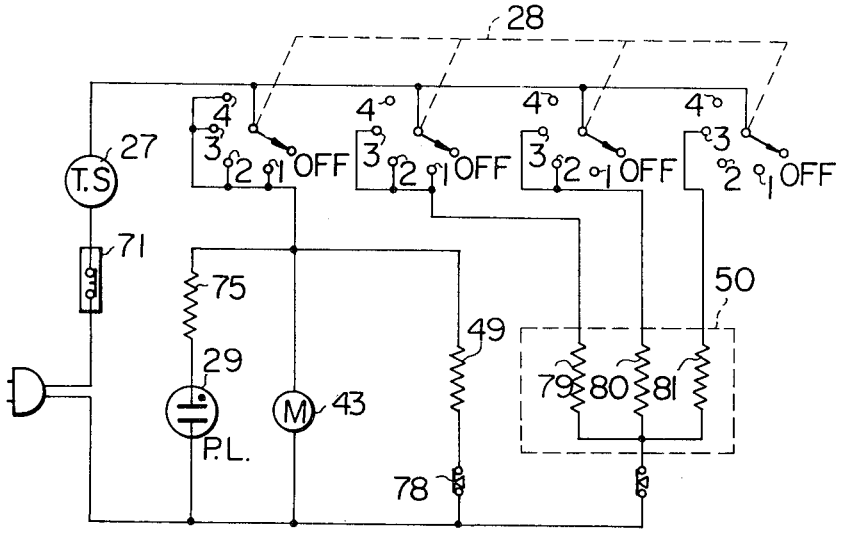
FIG. 19 is an electric circuit for the device of FIG. 12.

In FIG. 19, there is shown an example of the electric circuit of the device, in which 71 is the limit switch, 27 is a timer, 28 is a control switch which can be turned to any of "OFF" position and four step positions of "1" through "4", in which the first three positions "1" to "3" are for rendering the hood's atmosphere to be of low, medium or high temperature, respectively, and the last position "4" is to perform a treatment operation with the motor 43 for rotating the fan 45 and the heater 49 for generating the steam actuated. The heater49 is connected in series to a thermostat 78 for preventing the temperature thereof from rising excessively. A voltage dividing resistance 75 is connected in series with the pilot lamp 29. The heater 50 comprises three heat generating resistances 79 to 81 which are connected respectively to all, two and one of the selective switch positions "1" to "3" of the control switch 28 for determining the variable temperature of the heater 50.

Figure 20:
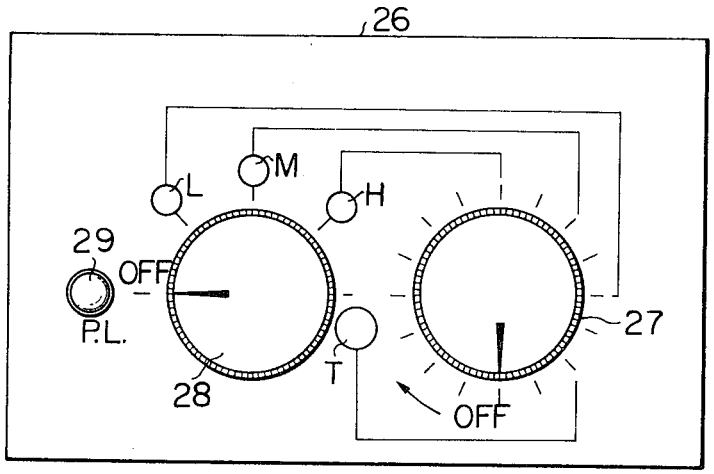
FIG. 20 is a magnified plan view of the operating panel of the device of FIG. 12.

FIG. 20 shows in a magnified plan view the operating panel 26, in which the rotary control switch 28 selectively adjusts the temperature within the hood to be low, medium and high and also the atmosphere in the hood to be suitable for the treatment as will be detailed later, and the timer 27 is to set the time required for the respective operations of the device with the different temperatures of for the treatment. The pilot lamp 29 indicates that the device is in ON or OFF state.

The manner in which the device according to the present invention is to be used shall now be explained.

The device in the folded state as shown in FIG. 12B is first set up to be in the state for use as shown in FIG. 12A by pulling up the hood 20 to erect the stand 12, 13 and setting the hood to be at a proper angle with respect to the stand by tightly fastening the knob 16. In this state, the pin 34 fixed to the so that the stand will come into the vertical slot 38 of the movable plate 37 and the plate 37 will be rotated by the resilient force of the spring 40 to lock the pin 34 in the slot 38, so that the stand is fixed in the erected position as shown in FIGS. 13A and 13B. Since the hood 20 is provided with clutch means between the fixture member 65 and the bracket 14 so that the resilient force of the spring 59 will be applied to the clutch disks 61 and 63 to normally retain them in their meshed position, the hood 20 can be rotated by releasing the resilient force of the spring 59 with a rotation of the knob 16 to any desired position angled with respect to the stand 12, 13, at which position the hood can be locked by tightening the knob 16. The cord 42 disposed in the stays 12 and 13 is preferably formed in a coil shape so that the cord will freely expand and contract in response to the telescopic movement of the stay 13.

Figure 21:
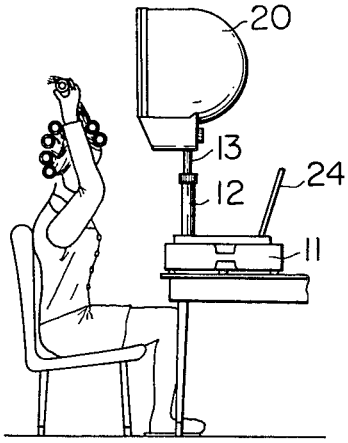
FIGS. 21 to 23 are explanatory views of the various manners in which the device of FIG. 12 may be used.
Figure 22:
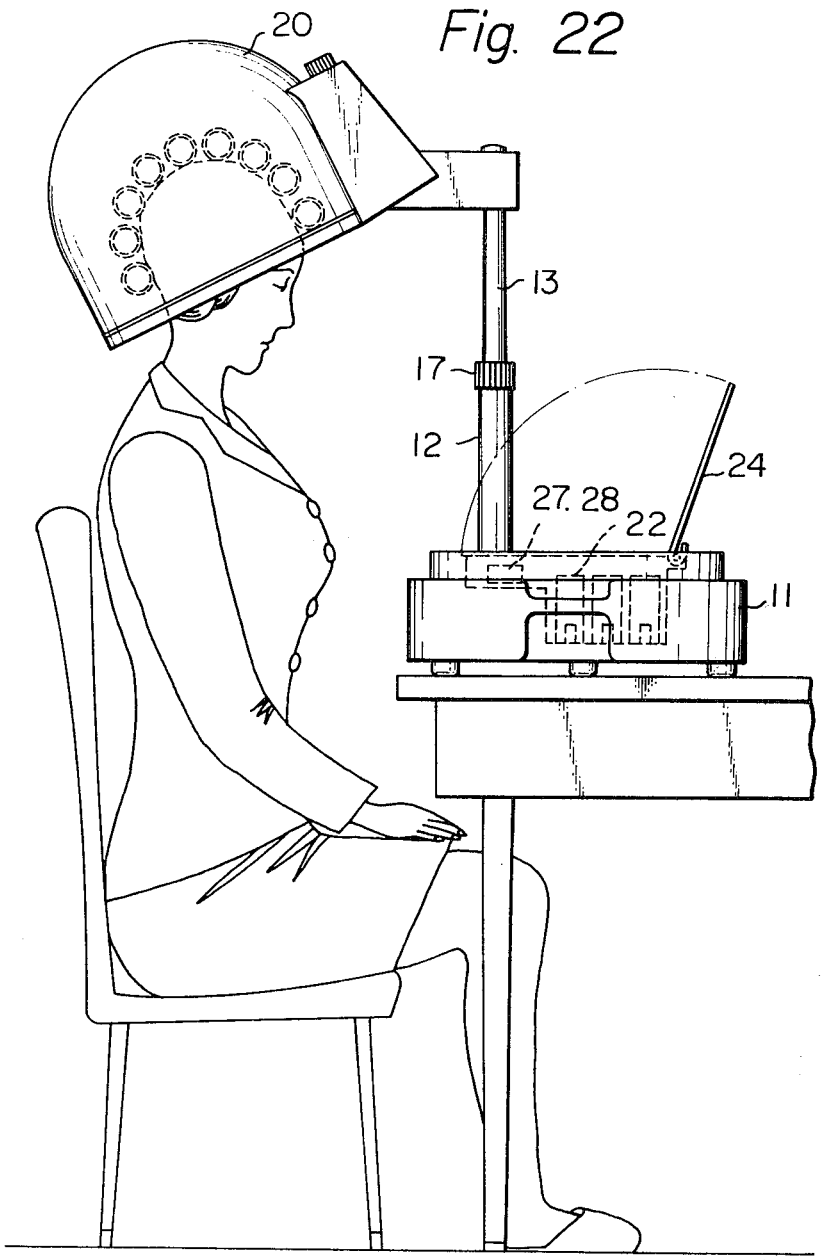

After the hood and body are thus readied for use, the cap 51 of the steam generator 46 is removed, water is poured into the boiler 47 and the cap 51 is tightly fastened again. Then, as shown in FIG. 21, the hood 20 is lifted to its most rotated position, the lid 24 in the body 11 is raised, net curlers 22 are taken out of the accessory containing recess 23, hair is wound on the curlers 22, the hood 20 is rotated to a position of covering the user's head as shown in FIG. 22 and, at this time, while seeing the mirror on the lid 24, the angle of the hood 20 and the height of the stand 12, 13 are adjusted so that the position of the head will be most comfortable. Since the stand 12, 13 is offset from the centre of the body 11, it will not be in the way when the user observes the mirror and reaches over the device body.

Next, the control switch 28 is set, for example, at the medium temperature position indicated by "M" in the panel 26 of FIG. 20, the timer 27 is set in the position corresponding to the "M" position as indicated in the panel, then air delivered by the fan 45 rotated will be heated by the two heating resistances 79 and 80 of the heater 50 and, at the same time, steam will be generated by the steam generator 49 and added to the heated air. Such warm and wet air will be carried into the hood 20 through the duct 53 and the air, having warmed and humidified the interior atmosphere of the hood 20, will be sucked into the duct 53 by the fan 45 so as to be recirculated into the hood. When the user's head with the hair wound on the curlers is kept in the warmed and humidified hood 20 for the time set by the timer, the hair is set. Where the rotary switch 28 is switched to the low or high temperature position indicated by "L" or "H" on the panel 26, the heating resistance distribution of the heater 50 will respectively vary so that, in the case of "L" position, only the resistance 79 will work but, in the case of "H" position, all the resistances 79, 80 and 81 will be active, and the temperature and humidity within the hood will consequently vary. In addition to varying the temperature and humidity conditions, the set time of the timer may also be correspondingly varied. Further, in case the control switch 28 is set at the treatment position indicated by "T" on the panel 26, the heater 50 will be switched off, but the steam generated by the steam generator 46 only will be fed into the hood 20 by the air delivered by the fan 45 and the air, having warmed and humidified the interior of the hood, will be further sucked in by the fan 45 so as to recirculate within the hood. As a result, the interior of the hood will be under the conditions of about 40° and 100% so that, when hair is kept in the hood under such conditions longer than a fixed time, the hair will be adjusted in humidity.

While the manner of varying the temperature and humidity conditions within the hood is to be achieved in the present instance only by switching the heater for heating air selectively, it will be appreciated that the temperature and humidity within the hood may be varied also by varying the capacity of the heater for heating air, the amount of generated steam and the amount of air.

Figure 23:
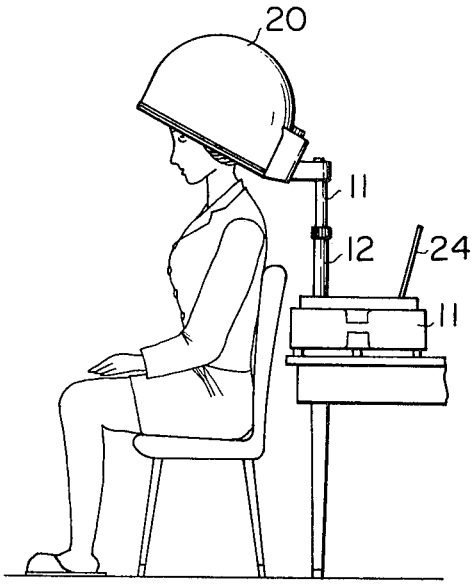

When the proper time for treatment elapses, the hood is removed and the curlers are removed. In wearing the hood, the user can sit either facing the unit or reversely as shown in FIG. 23.

Now, in the case of storing the device with the hood folded over the device body, initially the fixing cap 17 on the stand 12, 13 is loosened, the stand is contracted to the minimum length, then the fixing cap 17 is tightened again and thereafter the stand is rocked while depressing the push button 30 to lay the stand in the groove 21. After placing the curlers 22 in the recess 23 of the device body 11, the lid 24 is rotated to cover the recess. The hood 20 remained in vertical position and by loosening the knob 16, the hood 20 may be rotated over the body 11 so that the device will be in the state for storage as shown in FIG. 12B. When the hood 20 is thus placed over the device body 11, the lower edge of the U-shaped groove 56 of the hood will depress the push button 70 of the limit switch 71 to completely switch off the source current. In manually carrying the device as folded, projected parts between the recesses 18 and 19 provided on both sides of the body may be held by hands so as to be easy to hold as a handle for carrying the device.

According to the present invention, it is possible to perform the hair setting durably by simultaneously warming and humidifying the interior atmosphere of the hood to simultaneously warm and humidify the hair at least in the range enclosed with five points in FIG. 8 of (1) a temperature of 40° C. and relative humidity of 80%, (2) a temperature of 40° C. and relative humidity of 62%, (3) a temperature of 55° C. and relative humidity of 30%, (4) a temperature of 80° C. and relative humidity of 30% and (5) a temperature of 80° C. and relative humidity of 80%, without causing the hair to be ill affected. Further, when the temperature and humidity range is freely selected as desired by the user, it is possible to perform the hair setting within a short time, or at a low temperature.

Further, as the wet air is circulated within the hood with the provision of the inward curved U-shaped groove at the lower edge of the hood, the efficiency of elevating the temperature and humidity can be remarkably improved, the amount of generated steam and the capacity of the heater for heating air can be minimized and the electric power consumption can be reduced. Further, as the effective air circulating system is adopted, the hair setting efficiency will be well improved and, therefore, the steam generator and air heater can be also minimized. In particular, the amount of generated steam becomes so small that the amount of water required for the entire time for using the hair set device will be small so that preheating time until steam is generated will be reduced.

Referring more in detail to the hair setting efficiency, in the case when the hair setting is performed under the temperature and humidity conditions of a room atmosphere of, for example, respectively 20° C. and 60%, it is preferable to make the temperature and humidity conditions within the hood to be respectively 60° C. and 60% and, for this purpose, the respective elements may be set in the device of the present invention respectively at the capacities of an amount of generated steam of 2.3 c.c./mm. which requiring a capacity of the steam generator of 105 watts, a capacity of the heater for heating air of 124 watts and an amount of air of 0.17 $m^3$./mm. which requires a power consumption of the motor of only 1 to 2 watts. That is, the purpose can be attained with such small power consumption as a total capacity of 230 watts. In the case of, for example, a conventional salon type dry dryer available in commercial market, the power consumption is usually at the level of 700 watts or higher. Further, while the required time for the hair setting is about 10 minutes in the conventional salon type dry dryer, only about 3 minutes is required according to the present invention. In comparing the power consumptions, that of the conventional apparatus is 116.7 WH but that of the present invention is only 11.5 WH. Thus, only a very small power consumption is required according to the present invention.

Further advantages of the present invention are as follows:

As a circulating system which prevents the heat from flowing out of the hood is provided, the loss of heat is small making it easy to protect the user's face.

Further, by providing the ribs projecting on the inside wall of the hood, a proper clearance between the inside of the hood and the user's head can be defined so that any condensation on the inside of the hood will be thereby prevented from being deposited on the hair. The path for hot air flow is not clogged by the head or hair and, therefore, the temperature and humidity inside the hood are entirely stabilized.

In addition, as the air flow rectifying means is provided at the end of the duct within the hood so that the position, number and size of air blowing outlet may be optimumly determined, hot air once accumulated here can be made to flow in various directions, and any fluctuation of the temperature and humidity within the hood can be minimized.

The provision of the U-shaped groove at the inner lower edge of the hood prevents the hot air from flowing out of the hood and, at the same time, water condensed on the inside wall of the hood can be effectively collected in the groove for preventing such water from being deposited on the user's face and body.

As control means for selectively varying the temperature and humidity within the hood are provided, hair setting at a low temperature for a long time, or at a high temperature for a short time and the like as desired by the user can be freely selected. Even in the case of a low temperature, the present invention enables hair setting within a period of only about 10 minutes, which period is usually required by conventional apparatuses operating at a much higher temperature.

As the hood can be rotated with respect to the stand and the stand can be folded and recessed into the device body, the device is very convenient for storage.

As the limit switch is provided at an engaging part of the hood when folded with the device body, the switch will never be turned ON as long as the hood is folded on the device body so that a positive safety guard can be achieved.

Figure 25:
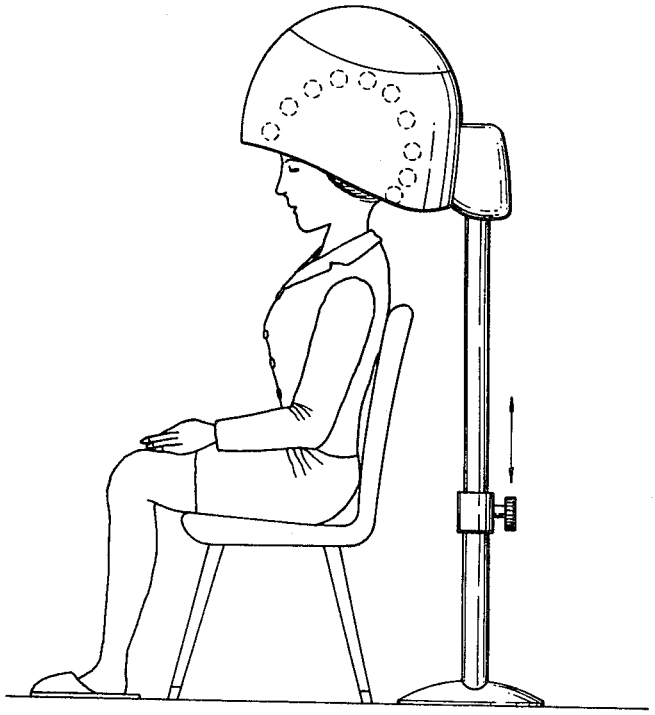
Fig. 25 (PRIOR ART)
FIG. 25 shows the manner of use of conventional hair setting devices.

Yet further, while any conventional devices of the type in which hair is to be set in the hood must be used with the stand and even the control panel at the back of the user as shown in FIG. 25 so that, in adjusting the relative position of the hood to the head, the user will have to remove her head repetitively out of the hood moving out of sitting position until a proper and pleasant relative position is achieved; thus the positional adjustment of the hood is very troublesome and, in winding hair on the curlers or arranging the hair before and after the setting, such operation must be performed at a place remote from the device to be used. By contrast, the present invention allows the user to simply sit facing the device body, as well as the mirror and accessory container provided in the body, so that the relative position of the hood to the user's head can be adjusted while sitting and wearing the hood and the entire course of hair setting can be carried out continuously sitting in front of the device, without moving to any other place such as a separate mirror stand.

What is claimed is:

1. The method of curling hair comprising the step of applying an atmosphere of wet air prepared by simultaneously warming and humidifying air to rolled hair, wherein said atmosphere is within the range defined by respective temperature and relative humidity conditions of 47° C. and 80%, 47° C. and 62%, 62° C. and 30%, 80° C. and 30% and 80° C. and 80% for a minimum curling time of 3 minutes at a room atmosphere substantially of a temperature of 20° C. and a humidity of 40%.

2. The method according to claim 1 wherein said range of atmosphere conditions is extended to include the additional range defined by respective temperature and relative humidity conditions of 44° C. and 80%, 44° C. and 62% and 59° C. and 30% and the minimum curling time is 5 minutes.

3. The method according to claim 2 wherein said range of atmosphere conditions is extended to include the additional range defined by respective temperature and relative humidity conditions of 42° C. and 80%, 42° C. and 62% and 57° C. and 30% and the minimum curling time is 7 minutes.

4. The method according to claim 3 wherein said range of atmosphere conditions is extended to include the additional range defined by respective temperature and relative humidity conditions of 40° C. and 80%, 40° C. and 62% and 55° C. and 30% and the minimum curling time is 9 minutes.

5. The method of curling hair comprising the step of applying an atmosphere of wet air prepared by simultaneously warming and humidifying air to rolled hair, wherein said atmosphere is within the range defined by respective temperature and relative humidity conditions of 68° C. and 80%, 52° C. and 74%, 52° C. and 57%, 70° C. and 30%, 80° C. and 30% and 80° C. for a minimum curling time of 3 minutes at a room atmosphere substantially of a temperature of 20° C. and a humidity of 60%.

6. The method according to claim 5 wherein said range of atmosphere conditions is extended to include the additional range defined by respective temperature and relative humidity conditions of 54° C. and 80%, 48° C. and 77%, 48° C. and 57% and 66° C. and 30% and the minimum curling time is 5 minutes.

7. The method according to claim 6 wherein said range of atmosphere conditions is extended to include the additional range defined by respective temperature and relative humidity conditions of 45° C. and 80%, 45° C. and 57% and 63° C. and 30% and the minimum curling time is 7 minutes.

8. The method according to claim 7 wherein said range of atmosphere conditions is extended to include the additional range defined by respective temperature and relative humidity conditions of 43° C. and 80%, 43° C. and 57% and 61° C. and 30% and the minimum curling time is 9 minutes.

9. The method of curling hair comprising the step of applying an atmosphere of wet air prepared by simultaneously warming and humidifying air to rolled hair, wherein said atmosphere is within the range defined by respective temperature and relative humidity conditions of 69° C. and 62%, 69° C. and 53%, 80° C. and 44% and 80° C. and 66% for a minimum curling time of 3 minutes at a room temperature substantially of a temperature of 20° C. and a humidity of 80%.

10. The method according to claim 9 wherein said range of atmosphere conditions is extended to include the additional range defined by respective temperature and relative humidity conditions of 63° C. and 67%, 63° C. and 53%, 80° C. and 37% and 80° C. and 73% and the minimum curling time is 5 minutes.

11. The method according to claim 10 wherein said range of atmosphere conditions is extended to include the additional range defined by respective temperature and relative humidity conditions of 71° C. and 80%, 59°

C. and 73%, 59° C. and 53% and 80° C. and 32% and the minimum curling time is 7 minutes.

12. The method according to claim 11 wherein said range of atmosphere conditions is extended to include the additional range defined by respective temperature and relatively humidity conditions of 57° C. and 80%, 57° C. and 53% and 80° C. and 30% and the minimum curling time is 9 minutes.

13. A hair setting device for rolled hair comprising means for simultaneously warming and humidifying air, means for blowing said warmed and humidified air to rolled hair, means for confining said blown air substantially around said rolled hair, and means for controlling the atmosphere of the blown air within said confining means to be within the range defined by respective temperature and relative humidity conditons of 47° C. and 80%, 47° C. and 62%, 62° C. and 30%, 80° C. and 30% and 80° C. and 80% for a minimum curling time of 3 minutes.

14. The device according to claim 13 wherein said means for controlling the atmosphere is effective to lower the range of temperature conditions by about 2° C. for each additional 2 minute increment of curling time up to an aggregate of 9 minutes curling time.

* * * * *